United States Patent [19]

Stazzone

[11] 4,120,499

[45] Oct. 17, 1978

[54] RING TOSS GAME DEVICE

[76] Inventor: Anthony N. Stazzone, 5703 Haverhill Dr., Parma, Ohio 44129

[21] Appl. No.: 791,018

[22] Filed: Apr. 26, 1977

[51] Int. Cl.[2] ..... A63B 67/06

[52] U.S. Cl. ..... 273/100; 273/102 R; 273/102 S

[58] Field of Search ..... 273/100, 102 R, 102 S; 46/28, 29

[56] References Cited

U.S. PATENT DOCUMENTS

| | | | |
|---|---|---|---|
| 411,221 | 9/1889 | Gooch | 273/100 |
| 533,102 | 1/1895 | Thomson | 273/100 |
| 611,915 | 10/1898 | Klauder | 273/100 |
| 731,192 | 6/1903 | Lewis | 273/100 |
| 1,036,438 | 8/1912 | Brown | 273/100 |
| 1,501,942 | 7/1924 | Carman | 273/100 |
| 1,617,127 | 2/1927 | Levay | 273/100 |
| 2,943,415 | 7/1960 | Viken | 46/28 |

*Primary Examiner*—William H. Grieb

*Attorney, Agent, or Firm*—Clarence A. O'Brien; Harvey B. Jacobson

[57] ABSTRACT

A ring toss game device having a hollow game board forming a storage cavity and an airtight floatation chamber. The game board includes a frame partially formed by substantially parallel, planar faces usable alternatively to play different games. Pegs are selectively mounted on the faces of the frame of the game board in a removable manner to provide pins for retaining rings tossed at the board during the playing of a ring toss game with the device.

6 Claims, 4 Drawing Figures

2
68
10
28
16
12
58
46
C
14

68
34
26
14
36
48
50
54
30
52
46
18
60
28
56
58
62
22
38
66
44
S
64
42
40
24

68
18
48
30
64
26
32
22
34
36
66
42
38

20

RING TOSS GAME DEVICE

BACKGROUND OF THE INVENTION

1. Field of the Invention

This invention relates generally to game devices, and particularly to a device used for playing a ring toss game.

2. Description of the Prior Art

Ring games of various construction are known which employ hooks and pegs to retain rings on an associated playing board. U.S. Pat. Nos. 731,192, issued June 16, 1903, to L. B. Lewis, and 1,036,438, issued Aug. 20, 1912, to A. H. Brown, disclose ring toss games employing game boards having triangular configurations in plan and having upstanding pegs associated therewith. U.S. Pat. No. 611,915, issued Oct. 4, 1898, to J. Klauder, discloses a container or box having ring receiving hooks on the exterior thereof, while U.S. Pat. No. 533,102, issued Jan. 29, 1895, to M. Thomson, discloses a triangular target pin arrangement with indicia associated with the pins. U.S. Pat. No. 411,221, issued Sept. 17, 1889, to C. Gooch, discloses a folding leg prop and a hollow box for storing pegs which are mounted on the front of the game device when in use for playing a game, and U.S. Pat. No. 1,501,942, issued July 22, 1924, to D. L. Carman, discloses a ring toss device in which the pegs are removable from and have circles concentric therewith on the game board of the device.

SUMMARY OF THE INVENTION

It is an object of the present invention to provide a ring toss game device comprising a game board which permits various different ring toss games to be played.

It is another object of the present invention to provide a ring toss game device comprising a game board having an internal storage cavity.

It is yet another object of the present invention to provide a ring toss game device comprising a game board having an airtight floatation chamber.

It is a still further object of the present invention to provide a ring toss game device comprising a game board which can be supported in more than one manner orientation.

It is a still further object of the present invention to provide a ring toss game device employing pegs which are disassembled for easy storage and which are removably mounted on the associated game board for movement to another location and/or to storage.

These and other objects of the present invention are achieved by providing a ring toss game device having: a game board including a frame provided with a plurality of apertures disposed for removably receiving a peg or pegs to be removably mounted on the game board; at least one peg removably mounted on the game board; a support attached to the game board for permitting the game board to be variously disposed relative to a supporting structure or surface; and at least one ring to be tossed at the game board for retention by the peg, or by a particular one of the pegs, when the ring happens to engage with the peg, or pegs.

The frame of the game board preferably comprises a hollow container provided with an interior cavity which functions to store pegs, rings, and the like, when the game device is not being used. An opening is provided in a wall of the container for permitting access to the cavity. The remainder of the wall in which the opening is provided is in the form of a double-wall partially forming an airtight chamber within the frame so as to permit the game board to float in a body of liquid, such as water, in the event the board is accidentally dropped into such liquid body.

The frame is further formed by two spaced, substantially parallel, planar faces between which extend a side wall in which is provided the aforementioned opening and which partially forms the airtight chamber. A suitable closure can be pivotally mounted on the side wall adjacent the opening for selectively blocking and unblocking the opening, as desired.

The apertures arranged for receiving a peg or pegs according to the invention are advantageously provided in the parallel, planar faces of the frame. Each peg preferably includes a bottom portion provided with a projection selectively engaged in one of the apertures provided in the faces of the frame, and a top portion forming a head of the peg. The bottom portion and top portion of the peg are provided with a snap-fastener arrangement which permits the portions to be removably attached to one another.

Each of the faces of the frame are also provided with at least one slot, with the support arrangement including a planar stand provided with a tab removably engaged in the slot of a one of the faces. By arranging the stand in a substantially vertical orientation with respect to a support surface, the game board will be itself disposed with the faces thereof in a substantially vertical orientation, or extending substantially perpendicularly from a plane of the support surface.

A loop assembly is advantageously mounted at an upper portion of the frame for permitting selective suspension of the frame from a support structure either for storage of the device or for actual play.

These together with other objects and advantages which will become subsequently apparent reside in the details of construction and operation as more fully hereinafter described and claimed, reference being had to the accompanying drawings forming a part hereof, where in like numerals refer to like parts throughout.

DESCRIPTION OF THE PREFERRED EMBODIMENTS

Figure 1:
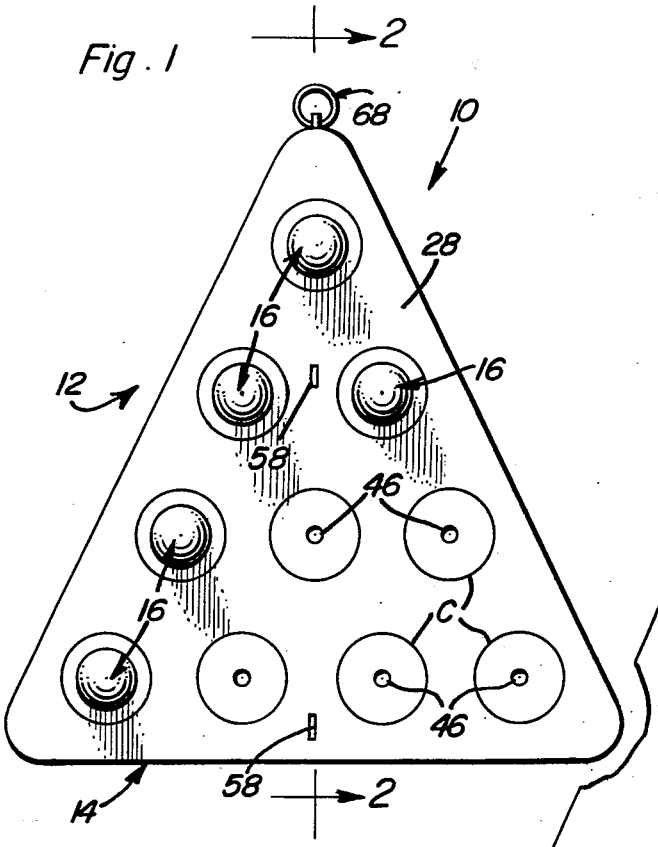
FIG. 1 is a schematic, plan view showing one face of a game board constructed in accordance with the present invention.
Figure 2:
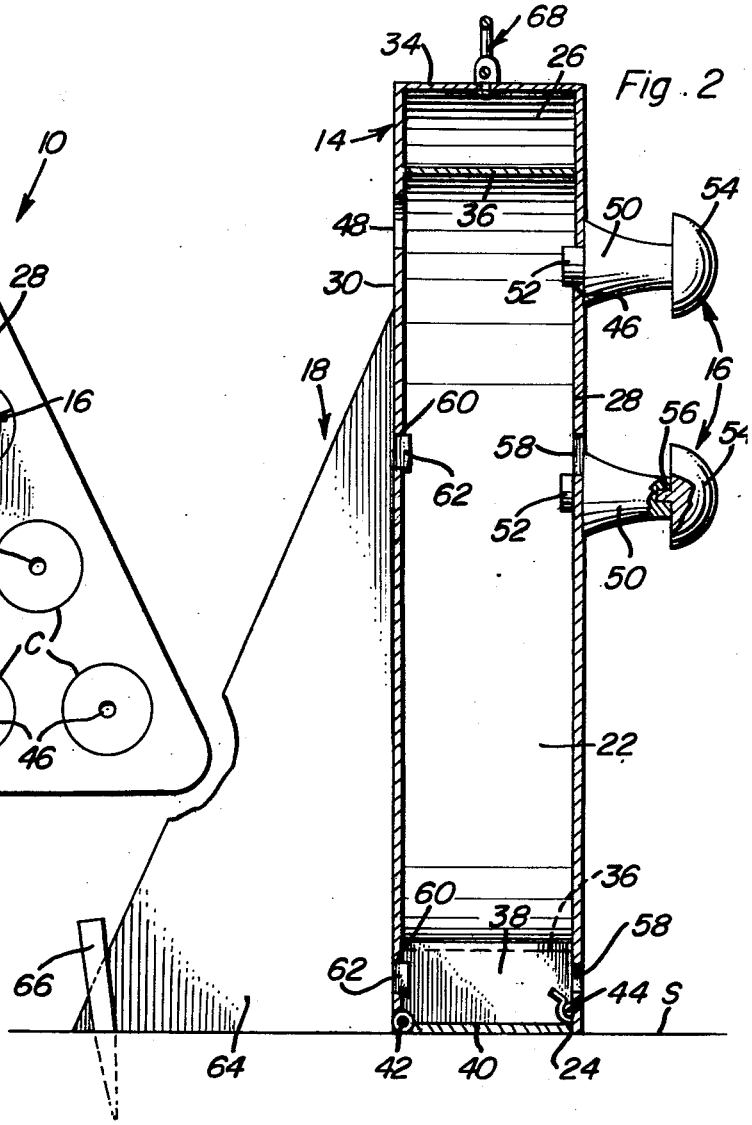
FIG. 2 is an enlarged, fragmentary, sectional view, taken generally along the line 2—2 of FIG. 1, but with the game board shown disposed on a suitable support surface.
Figure 3:
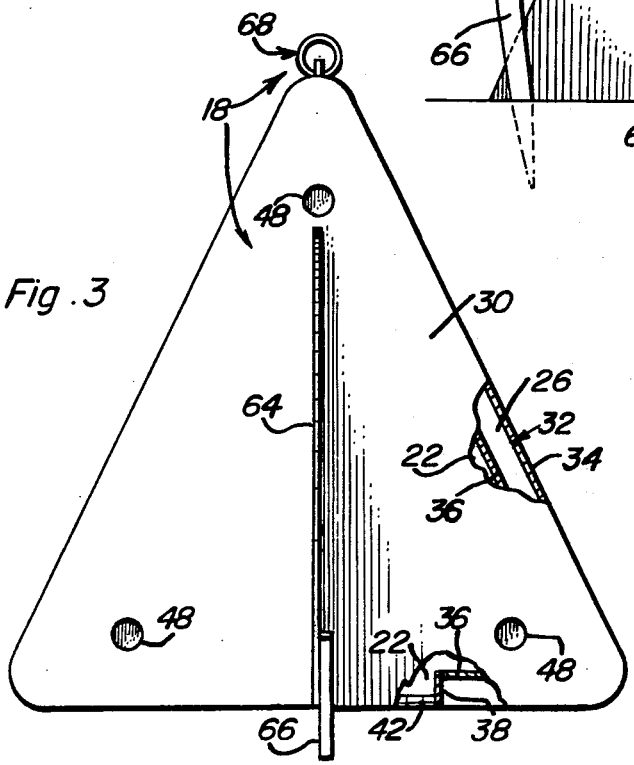
FIG. 3 is a schematic, partly cut away, plan view, similar to FIG. 1, but showing the reverse face of the game board.
Figure 4:
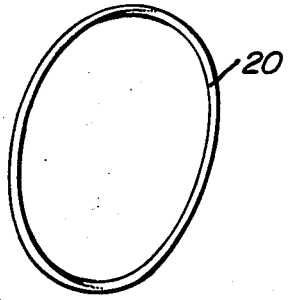
FIG. 4 is a perspective view, partly cut away in a section, showing a ring according to the present invention.

Referring now more particularly to the figures of the drawings, a ring toss game device 10 according to the present invention includes a game board 12 built around a frame 14 forming a support for removably receiving pegs 16. A support arrangement 18 is attached to game board 12 for permitting board 12 to be variously disposed as on a support surface or support structure during storage and play, while FIG. 4 shows one of a plurality of hollow rings 20 to be tossed at board 12 for selective retention by peg 16 during the playing of a game with device 10.

Frame 14 comprises a hollow container provided with an interior cavity 22 and an opening 24 disposed so as to permit access to cavity 22 from outside of frame 14. Pegs 16 and rings 20 can be selectively stored within cavity 22 as is convenient so as to provide an integral unit for storage, and the like. The remainder of the wall of frame 14 in which opening 24 is provided is in the form of a double-wall arrangement partially forming an airtight chamber 26 within the frame 14, which chamber 26 permits frame 14 to float in a liquid, such as water, in which game board 12 might accidentally find itself.

Frame 14 is formed by two spaced, substantially parallel, planar faces 28 and 30 and a side wall 32 which is the wall referred to above that extends between and around the periphery of the faces 28 and 30 for substantially enclosing a space including cavity 22 and chamber 26 between the faces 28 and 30. Opening 24 is formed in side wall 32, with the latter including an outer surface 34 and an inner surface 36, with the latter partially forming the cavity 22. End surfaces 38 enclose chamber 26 adjacent opening 24.

A closure 40 is pivotally mounted as by a conventional hinge 42 on face 30 at an edge thereof adjacent opening 24 for selectively blocking and unblocking the opening 24. A suitable spring latch 44, and the like, is disposed on closure 40 at the edge thereof opposite the edge attached to hinge 42 for retaining closure 40 in position blocking the opening 24. Although not shown in the drawings, a suitable handle, and the like, such as a finger hole, or pivotally mounted loop, is advantageously attached to the outer surface closure 40 for facilitating opening of the closure 40 when it is desired to move same from its illustrated position blocking opening 24 to a position (not shown) wherein opening 24 is unblocked and access is available to cavity 24.

Face 28 is provided with at least one aperture 46 and preferably the illustrated plurality of apertures 46, which mountingly receive a portion of the peg 16 for permitting the peg 16 to be removably mounted on board 12. Indicia advantageously in the form of the illustrated circles designated C is provided on face 28, with the circles being disposed concentrically of an associated ones of the apertures 46 for forming target areas for a peg 16 mounted on face 28 by means of the apertures 46. In a like manner, apertures 48 are provided on face 30 in order to receive suitable pin elements (not shown) when it is desired to use the face 30 of board 12 to play a game different from the game normally played on face 28 on board 12.

Each of the pegs 16 includes a bottom part 50 provided with a projection 52 selectively engageable in one of the apertures 46 provided in face 28 of frame 14, and a top part 54 forming a head of a peg 16 when selectively attached to bottom part 50 as by a suitable snap-fastener, such as the illustrated pin and socket fastener, 56. That is, the pin of fastener 56 is provided on one of the parts 50, 54, and the socket is provided on the other parts 54, 50, as desired. Construction of peg 16 in two parts 50, 54 not only facilitates storage of the pegs 16 within the cavity 22, but also permits the bottom part 50 to be used alone as a pin extending from the face 28 of board 12.

Each of the faces 28 and 30 are provided with at least one, and preferably the illustrated pairs of slots 58 and 60 arranged along a perpendicular to one of the edges of frame 14 so as to selectively receive the tab or tabs 62 provided on one edge of a stand 64. As will be appreciated, stand 64 is generally in the form of a right triangle with the tab 62 provided on one leg thereof such that the other of the legs abuts a support surface S in such a manner that board 12 will be supported on support surface S in a substantially vertical orientation with the edge of board 12 from which the perpendicular is taken along which slots 58 and 60 are provided forming a base of the board 12.

While board 12 can take any suitable shape, a preferred configuration in plan for board 12 is the illustrated equilateral triangular form.

A stake 66 is advantageously attached to the planar stand 64 outwardly of the point of attachment of stand 64 to a face 30, 28 for permitting the device 10 to be anchored into ground which may be forming the support surface S. As can be appreciated, stand 64 can be removed from the slot 60 provided in face 30, and either separated completely from board 12 or inserted into the slots 58 provided in face 28 for permitting face 30 of board 12 to be used as a game playing surface.

Support arrangement 18 also includes a loop assembly 68 mounted on frame 14 at a vertex of the equilateral triangle opposite the side of the triangular shaped frame 14 which is being used as a base for supporting board 12 on a support surface S in order to permit selective suspending of frame 12 from a suitable support (not shown) either for storage of device 10 or for playing of a ring toss game therewith.

While many different games can be played with a ring toss game device 10 according to the present invention, for example of a game which may be played with the apparatus is as follows:

Object of the Game

To score as many points as possible by throwing rings 20 around pegs 16 from a specified distance away from board 12. Each peg 16 is a designated number of points.

The Play

1. Each player selects a set of colored rings 20, with each set containing, for example, six rings 20.
2. Each player then stands a set distance from board 12 and alternately throws one of rings 20 until each player has thrown all the rings.
3. Each player then totals the number of points scored by their rings 20.
4. Play continues until one player reaches a set number of points or until a predetermined time limit is reached to stop the game, with the winner being the player with the most amount of points.
5. In case the game has to be stopped, the player with the highest number of points is the winner.

Penalties

1. While a game is in progress, no player shall step over a line drawn on the ground or other playing surface at a predetermined distance from board 12.
2. All players must toss in rotation.
3. No player shall interfere with the other players.
4. If any of the preceding should occur, a player will be penalized by the number of points of the last ring scored by that player.

As can be readily understood from the above description and from the drawings, a ring toss game device according to the present invention provides a a simple, yet rugged, safe, and versatile apparatus for amusing persons of all ages.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A ring toss game device, comprising, in combination:

(a) a game board including a frame forming means for removably receiving a peg;

(b) a peg removably mounted on the board by the means for removably receiving;

(c) support means attached to the game board for permitting the game board to be variously disposed; and (d) a ring to be tossed at the board for retention by the peg during the playing of a ring toss game, the frame of the game board comprising a hollow container provided with an apertured interior cavity and an opening permitting access to the cavity, the peg and ring being selectively storable in the cavity, and a double-wall means partially surrounding and forming the interior cavity and an airtight chamber within the frame for permitting the frame to float in a liquid body, the frame being formed by two spaced, substantially parallel, planar faces and a side wall extending between and around the periphery of the faces for substantially enclosing a space between the faces, the space between the faces including the cavity and chamber, the opening permitting access to the cavity being formed in the side wall, with the side wall portion extending away from the opening being the double-wall means forming the airtight chamber in cooperation with the faces of the frame.

2. A structure as defined in claim 1, wherein each of the faces is provided with at least one aperture partially forming the means for removably mounting the peg.

3. A structure as defined in claim 2, wherein the peg includes a bottom part provided with a projection engaged in an aperture provided in one of the faces of the frame, a top part forming a head of the peg, and snap fastener means provided on the bottom part and top part for permitting the top part to be removably attached to the bottom part.

4. A structure as defined in claim 3, wherein the frame further comprises a closure pivotally mounted on the frame adjacent the opening for selectively blocking and unblocking the opening.

5. A structure as defined in claim 4, wherein each of the faces are also provided with a slot, and the support means includes a planar stand provided with a tab removably engaged in the slot of a one of the faces, with the peg being mounted on the other of the faces of the game board.

6. Apparatus as defined in claim 5, wherein the support means further includes a loop mounted on the frame for permitting selective suspending of the frame from a support structure.

* * * * *